US008955521B1

(12) United States Patent
Hanson

(10) Patent No.: US 8,955,521 B1
(45) Date of Patent: Feb. 17, 2015

(54) SMOKING APPARATUS

(71) Applicant: Jeremy Hanson, Maple Valley, WA (US)

(72) Inventor: Jeremy Hanson, Maple Valley, WA (US)

( * ) Notice: Subject to any disclaimer, the term of this patent is extended or adjusted under 35 U.S.C. 154(b) by 0 days.

(21) Appl. No.: 14/327,950

(22) Filed: Jul. 10, 2014

(51) Int. Cl.
*A24F 1/00* (2006.01)
*A24F 1/28* (2006.01)
*A24F 1/32* (2006.01)
*A24F 7/00* (2006.01)

(52) U.S. Cl.
CPC ... *A24F 1/00* (2013.01); *A24F 1/32* (2013.01); *A24F 7/00* (2013.01)
USPC ..... 131/191; 131/216; D27/162

(58) Field of Classification Search
CPC ..... A24F 1/04; A24F 1/01; A24F 1/16; A24F 1/32
USPC ..... 131/191, 216; D27/162–169
See application file for complete search history.

(56) References Cited

U.S. PATENT DOCUMENTS 1,493,236 A * 5/1924 Birchall ..... 131/192
D254,510 S * 3/1980 Shaak ..... D27/163
2011/0094524 A1* 4/2011 Glover ..... 131/224
2013/0269716 A1* 10/2013 Hoang et al. ..... 131/191
2014/0318557 A1* 10/2014 Bremer ..... 131/328

OTHER PUBLICATIONS

Glass Pipes by Grass City (downloaded from web.archive.org), Archive date Mar. 1, 2012 (downloaded on Aug. 5, 2014).*
Bicycle shape—glass smoking pipe vaporizer by Oyglass, Earliest sale/publication date May 21, 2014 (downloaded on Aug. 4, 2014).*
'Smokey'—Stoner Living Blog, "QuickStiq"—an Affordable, Simpler Way to Dab Hash oil/BHO and Other Cannabis Extracts—Product review, Sep. 8, 2014 [downloaded online Dec. 19, 2014].*

* cited by examiner

*Primary Examiner* — Anthony Calandra
(74) *Attorney, Agent, or Firm* — Lowe Graham Jones PLLC

(57) ABSTRACT

A smoking apparatus is disclosed herein for use in the consumption of liquefied herbs or resins. The invention utilizes a thermal tip with an orifice disposed therein, wherein the thermal tip is heated by an external heat source. Once heated, the thermal tip may glow due to the existence of thermal radiation emitting visible light. The tip is thereafter touched to the material to be consumed and the material is vaporized and drawn through the smoking apparatus. The smoking apparatus thereafter utilizes two offset reservoirs, connected by an air passageway in a series, where the reservoirs are separated by an s-shaped curve. The reservoirs in such a configuration with substantially trap large droplets of oil or resin, which improves the consumption and overall smoking experience. The reservoirs further cool the air before it is drawn into the lungs of the user, which also increases the enjoyment of the smoking experience.

20 Claims, 2 Drawing Sheets

SMOKING APPARATUS

FIELD OF THE INVENTION

This invention relates generally to a smoking apparatus, and more particularly to an improved device for smoking herbal oils and resins.

BACKGROUND OF THE INVENTION

Plants contain a variety of chemical compounds that are used to perform important biological functions within the plant to defend against attack from predators such as insects, fungi, and herbivorous animals. Known as "phytochemicals," these compounds can provide benefits on long-term or short-term health or mental state when consumed by humans, and many can be effectively used to treat human diseases and other conditions.

Smoking is a practice in which a substance, most commonly tobacco, is burned and the smoke is tasted or inhaled as combustion releases active substances such as nicotine and makes them available for absorption through the lungs. The most common method of smoking today is through cigarettes, which are primarily industrially manufactured but may also be hand-rolled from loose tobacco and rolling paper. Many other smoking implements exist, including cigars, pipes, bidis, hookahs, vaporizers, and bongs.

Smoking in the conventional sense, through inhalation of smoke as a byproduct of the combustion of the material to be smoked can be hazardous to one's health due to the existence of several irritating, toxic, and carcinogenic compounds in the smoke. The hazards of breathing in smoke containing harmful compounds from the combustion of herbal medicines, nicotine, and like plants may, in some cases, outweigh any benefits gained through the human consumption of plant phytochemical compounds.

One common alternative to smoking plants via combustion is to use a vaporizer. Vaporization is an alternative to burning that avoids the inhalation of many irritating toxic and carcinogenic by-products. During vaporization, the substance to be vaporized is heated to a temperature below its combustion point but high enough to release the active ingredient within a vapor. Very little or no combustion occurs during the vaporization process, so excessive ashy smokiness is largely avoided by vaporization of a material to be smoked or consumed.

Prior art vaporizors for consuming herbal oils and resins are generally well known. In one configuration, a portable pen-sized vaporizer device is provided with an elongated heating chamber, a battery, and a mouthpiece. This prior art device uses power from the battery to heat an element that comes into contact with oil, resin, or other material to be consumed, vaporizing the material within a chamber and releasing the smoke to a mouthpiece where it can be consumed by the user. These pen-sized vaporizers offer a relatively short or direct path for the vapor from the heating element to the mouth, thereby creating a somewhat hot and harsh experience that can contain relatively large droplets of suspended oil or resin within the vapor. Where the vapor to be consumed is relatively hot or where the vapor to be consumed includes relatively large droplets, the enjoyment of the smoking experience is decreased.

In another configuration of the prior art, a rig is provided that utilizes a super-heated metallic pin or nail, where the metallic pin is heated and put into contact with the oil, resin, or other material. In this rig configuration, the super-heated pin or nail is dabbed into the oil, resin, or other material to be smoked or consumed and thereafter quickly placed into a receptacle. The receptacle is in communication with another chamber filled with liquid such as water. Vapor from the super-heated pin or rod is pulled through the liquid and into a mouthpiece where it may be consumed by the user. Vaporized oil or resin consumed through the rig configuration is typically smoother and free of large droplets of water, however, this rig configuration involves several pieces and steps in order to deliver a smooth, easily consumable vapor stream.

As described above, prior art vaporizer devices for smoking herbal oils or resins involve complex arrangements, requiring battery power and multiple pieces for operation. In the case of the rig configuration, this prior art vaporizor device is also typically quite large and unable to be carried safely or easily in a pocket or purse. Furthermore, the pen-sized vaporizer, while small and compact, does an inadequate job of removing the large particles from the vapor, decreasing the smoothness and overall enjoyment of the smoking experience.

Accordingly, there is a need for a compact smoking apparatus for use with herbal oils and resins that delivers a smooth smoking experience with vaporized oil that is relatively free of large particles or droplets and sufficiently cool to be consumed by the user in a pleasant manner.

SUMMARY OF THE INVENTION

The invention is an apparatus for the consumption of herbal medicines, tobacco, or other plant material in liquid or resin form comprising a thermal tip constructed from material capable of being heated by an outside heat source to a temperature emitting visible light, an orifice disposed within the thermal tip, a conduit connecting the orifice to a mouthpiece, the conduit having a variable inside diameter over a distance x and a volume, wherein the mouthpiece is located at a distal end of the conduit, a first reservoir in fluid communication with the conduit; and a second reservoir in fluid communication with the conduit wherein at least a portion of the conduit is disposed between the first and second reservoirs and is curved along a first radius and a second radius.

The invention is also a smoking apparatus for the consumption of herbal medicines, tobacco, or other plant material in liquid or resin form comprising a thermal tip constructed from material capable of being heated by an outside heat source to a temperature emitting visible light, an orifice disposed within the thermal tip, an air passageway connecting the orifice to a mouthpiece, wherein the air passageway is connected to a first reservoir and a second reservoir wherein the first and second reservoirs are offset by a curve in the air passageway.

The invention is also an apparatus for vaporizing liquid or resin material for the purpose of inhaling vapor containing beneficial plant phytochemical compounds, the apparatus comprising a pipe constructed from substantially clear, low-thermal-expansion, borosilicate glass, wherein the pipe has a thermal tip with an orifice disposed within the thermal tip and an air passageway connecting the orifice to a mouthpiece, wherein the air passageway is connected to a first reservoir and a second reservoir wherein the first and second reservoirs are offset by a curve in the air passageway

BRIEF DESCRIPTION OF THE DRAWINGS

A preferred example of the present invention is described in detail below with reference to the following drawings.

DETAILED DESCRIPTION OF THE PREFERRED EMBODIMENT

Figure 1:
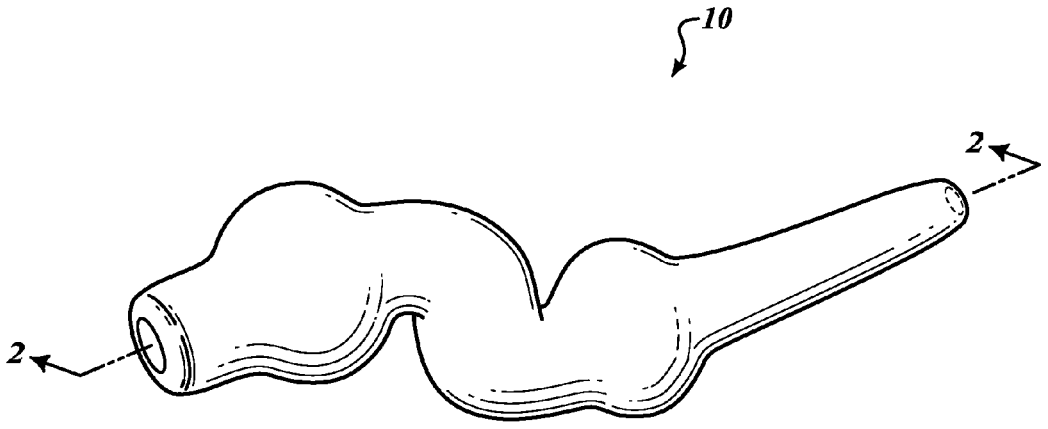
FIG. 1 is a perspective view of a smoking apparatus constructed in accordance with the principles of the invention.

FIG. 1 shows the smoking apparatus 10 useable in accordance with principles of the present invention. Smoking apparatus 10 is preferably constructed out of substantially clear, low-thermal-expansion, borosilicate glass. Borosilicate glass is generally a high melting point glass that can withstand very high temperatures without breaking or cracking. An example of commonly known devices constructed from borosilicate glass are jars and baking dishes.

Borosilicate glass is a type of glass with the main glass-forming constituents silica and boron trioxide. Borosilicate glasses are known for having very low coefficients of thermal expansion (~3×10−6/° C. at 20° C.), making them resistant to thermal shock, more so than any other common glass. Such glass is less subject to thermal stress and is commonly used for the construction of reagent bottles. Borosilicate glass is sold under such trade names as Borcam, Borosil, Suprax, Kimax, Pyrex, Endural, Schott, or Refinex.

While borosilicate glass is an ideal material for making glass pipes of the kind disclosed and claimed herein, it is not the only material useable for construction of the present invention. Borosilicate glass demonstrates adequate heat resistance, transparency and is also quite easy to melt and shape during the glass blowing process. Borosilicate glass may also be colored and transformed into a variety of different shapes through the glass blowing process.

In the formation of smoking apparatus 10, the borosilicate glass is heated to a molten temperature and blown into a shape such as that shown in FIG. 1. Glassblowing is a glass forming technique that involves inflating molten glass into a bubble (or parison), with the aid of a blowpipe (or blow tube). One of ordinary skill in the art of glass blowing will appreciate that each blown creation takes on a slightly different shape and configuration due to the natural variances and imperfections of the trade. It is difficult if not impossible to identically replicate objects constructed in such a matter. With this in mind, one of ordinary skill in the art will appreciated that the precise shape of the embodiment shown in FIG. 1 does not need to be replicated in order to practice the principles of the claimed invention. A number of various shapes and configurations can be utilized in an effort to practice the invention and the precise shape and configuration of the smoking apparatus 10 need not be identically replicated.

Figure 2:
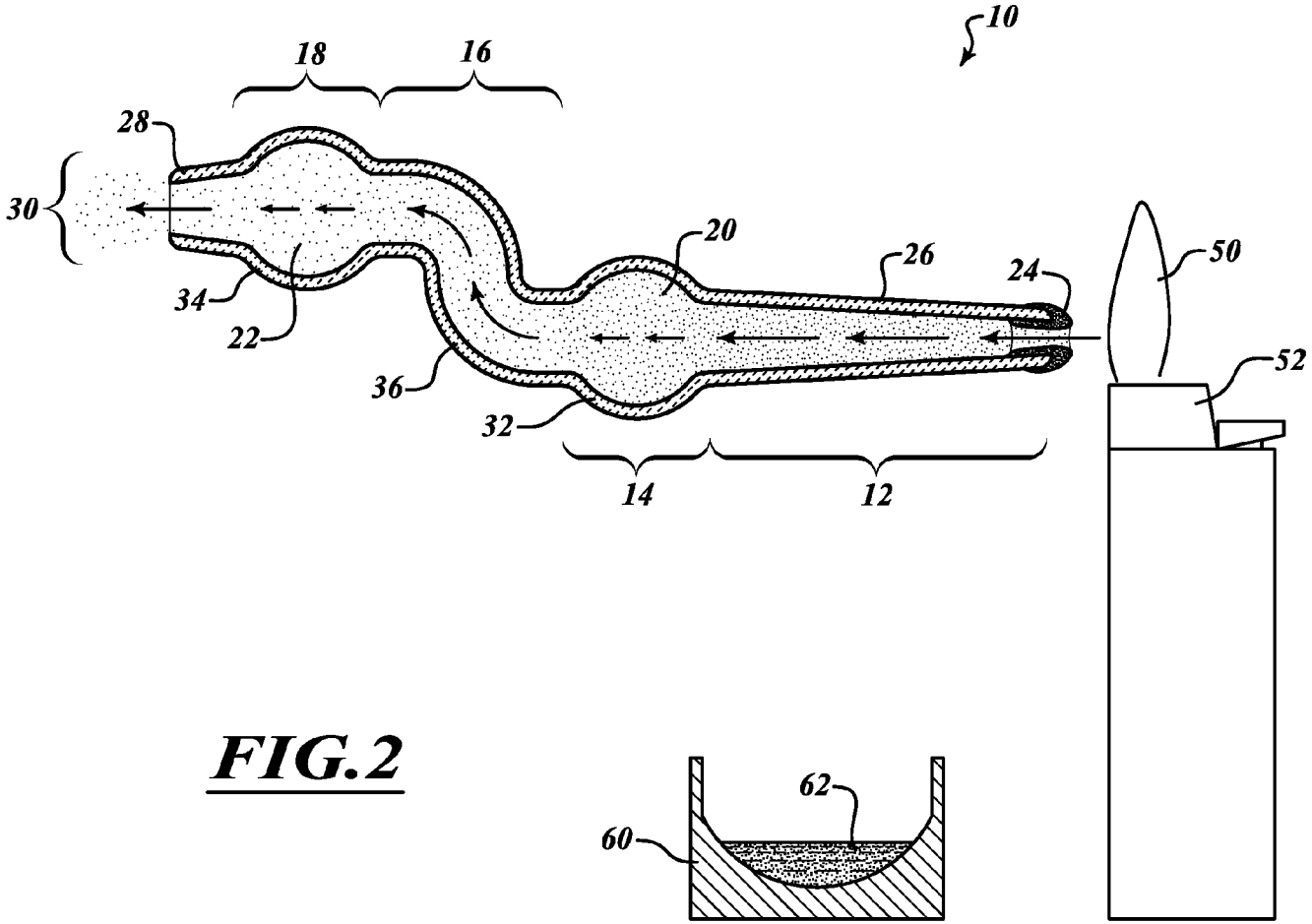
FIG. 2 is a section view of a smoking apparatus constructed in accordance with principles of the invention.

A cross section of the smoking apparatus 10 is seen in FIG. 2. According to principals of the present invention, the smoking apparatus is formed to include a thermal tip 24 wherein and orifice is disposed. An air passageway 2 (as seen in FIG. 1) is included and connects the orifice disposed within thermal tip 24 to a mouthpiece 28 (shown in in cross section at FIG. 2). Air passageway 2 in this embodiment is a conduit of varying inside diameter. In general, the inside diameter of the conduit increases from the orifice to the mouthpiece.

As seen in FIG. 2, the smoking apparatus 10 includes a first reservoir 14 and a second reservoir 18. The first reservoir 14 and second reservoir 18 are separated by an s-shaped curve 16. The path of s-shaped curve 16 takes a generally 90 degree turn upward relative to plane in which the thermal tip 24 is disposed. As the s-shaped curve turns upward, it forms an elbow 36 in the air passageway or conduit. Next, the air passageway or conduit takes another 90 degree turn to a plane generally parallel to the plane in which the thermal tip 24 is disposed.

First reservoir 14 and second reservoir 18 are generally spherical in shape, however, one of ordinary skill in the art will appreciate that a precise, mathematical sphere is not necessary for practice of the present invention. The present invention is more often comprised of substantial ball-shaped spheres that are formed into first reservoir 14 and second reservoir 18 by the glass-blowing process. Once again, a substantial variety and variation in terms of actual shape and size will be experienced due to the nature of the glass blowing process. As shown in the embodiment disclosed herein, the invention discloses the existence of reservoirs that have a volume that is generally greater than the volume of the air passageway when the volume of the air passageway is measured at a distance that is the same or substantially the same as the cross sectional diameter of the first reservoir 14 or second reservoir 18.

Put another way, if a distance x were measured at a point along the air passageway or conduit (excluding the distance across either the first reservoir 14 or second reservoir 18) and that distance x where the same as the cross sectional diameter of either the first reservoir 14 or second reservoir 18, the volume of this particular section of the air passageway or conduit will be less than the volume of the first reservoir 14 (by itself) and the second reservoir 18 (by itself).

This increased volume for the first reservoir 14 and second reservoir 18 create a dynamic within the air passageway or conduit such that vapor drawn into the orifice a thermal tip 24 is suddenly less densely packed, and this causes a slowdown in the velocity of the vapor as it travels along the air passageway conduit. A slower velocity for the vapor will cause some of the larger particles to fall out of the vapor trail and condense on the walls of the reservoirs. At the same time, the inside diameter of the air passageway or conduit is increasing. The increased inside diameter for the air passageway or conduit has a similar effect to slow the velocity of the vapor and promote the collection of larger vapor particles within the walls of the smoking apparatus 10.

In practice, smoking apparatus as shown in FIG. 1 is superheated at the thermal tip 24 by an external heat source. For example, a lighter 52 may be used to produce a flame 50. The flame is put into contact with thermal tip 24 until the tip glows red-hot, which is thermal radiation emitting visible light. When the thermal tip 24 is heated to a point that it glows red-hot, that is, to the point at which the mass at the thermal tip 24 emits thermal radiation in the form of visible light, that temperature is substantially high enough to vaporize liquid plant material or resin. IN this matter, the liquid plant material is not consumed by combustion, but is rather vaporized and atomized into millions of micro and macroscopic particles that flow within a densely packed vapor trail.

As shown in FIG. 2, the liquid plant material 62 to be consumed is shown in a container 60. The container 60 is preferably constructed from a high-temperature plastic that will not melt or deform when it comes into contact with the thermal tip 24 of the smoking apparatus 10.

As seen in FIG. 2, a cross section of smoking apparatus 10 is shown wherein the vapor is drawn into the orifice disposed within the thermal tip 24. At this point in the system the vapor is still very hot and very densely packed. Once the vapor is drawn into the orifice within the thermal tip 24 it is brought into the first reservoir 14. When the vapor 20 is drawn into the first reservoir 14 it is less densely packed that it was when it was first drawn into the smoking apparatus 10 at the thermal tip 24. Through the process of being drawn into the first reservoir 14, the vapor 20 spreads out and cools. Furthermore, the cooling of the vapor 20 causes larger particles to condense on the walls of the smoking apparatus and most notably at the bottom 32 of the first reservoir 14.

Likewise, vapor 22 is drawn into the second reservoir 18, wherein the vapor 22 is again more spread out than it was when it was inside of the first reservoir 14 and when it was first drawn into the orifice at thermal tip 24. At this point in the system, the vapor 22 is also now cooler and freer of large vapor particles. The larger particles still existing inside of vapor 22 are condensed within the walls of the second reservoir 18, most notably at the bottom 34 of second reservoir 18.

As seen in the cross section view of FIG. 2, the vapor, once it arrives at the mouthpiece of smoking apparatus 10, having gone through the increased inside diameter of the air passageway or conduit, having gone through the first reservoir 14, and having gone through the second reservoir 18, is substantially free of relatively large vapor particles. For the purposes of this specification the term "relatively large vapor particles" means those particles that are large enough to cause the consumer to cough or otherwise reject the vapor as too difficult to smoothly inhale.

The mouthpiece 28 is directly adjacent to the second reservoir in the preferred embodiment but other embodiments are envisioned where the mouthpiece is at a greater distance away from the second reservoir.

In still other embodiments of the invention, more reservoirs are included besides two. In general, the increased number of reservoirs, and the longer the air passageway, the cooler and more enjoyable the smoking experience, however, if the smoking apparatus 10 is too long, too large, or contains too many reservoirs, such that the overall volume of the system is too great to create any suction from the natural drawing power of the human lung, it will not function properly.

It should also be understood by one of ordinary skill in the art that smoking apparatus need not be constructed from glass. That it can be constructed from any material that will be able to withstand high temperatures and to be super-heated to a point at which it emits visible light, i.e., it glows red-hot.

Moreover, the glass version of the invention can take on any kind of decorative façade, and it can also be colored to attract the attention of the user and further increase the enjoyment of the smoking experience. The glass may also be tinted in a variety of colors to suit the aesthetic preference of the user.

One of ordinary skill in the art will understand that the present invention, while based on the assumption that a large portion of the material to be consumed will be vaporized, that complete or even substantial vaporization is not required. Under some circumstances, the material to be consumed will be of such a character or quantity that it my not completely be vaporized, that some amount of smoke from combustion may be present within the vapor stream. The invention is not depend upon complete vaporization to function properly or to otherwise be practiced.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A smoking apparatus for the consumption of herbal medicines, tobacco, or other plant material in liquid or resin form comprising:

a thermal tip constructed from material capable of being heated by an outside heat source to a temperature emitting visible light;

an orifice disposed within the thermal tip;

a conduit connecting the orifice to a mouthpiece, the conduit having a variable inside diameter over a distance x and a volume, wherein the mouthpiece is located at a distal end of the conduit;

a first reservoir in fluid communication with the conduit;

a second reservoir in fluid communication with the conduit wherein at least a portion of the conduit is disposed between the first and second reservoirs and is curved along a first radius and a second radius;

wherein the portion of the conduit that is disposed between said first and second reservoirs is free of any point of entry for outside air; and wherein the thermal tip is tapered.

2. The smoking apparatus of claim 1 wherein the conduit, thermal tip, and first and second reservoirs are constructed from substantially clear, low-thermal-expansion, borosilicate.

3. The smoking apparatus of claim 1, wherein the first and second reservoirs are substantially spherical in shape.

4. The smoking apparatus of claim 3, wherein the substantially spherical first and second reservoirs have a nominal volume that is greater than the volume of the conduit over distance x.

5. The smoking apparatus of claim 1, wherein the variable inside diameter of the conduit generally increases along a distance y between the orifice and the mouthpiece.

6. The smoking apparatus of claim 1 wherein the first radius is substantially 90 degrees.

7. The smoking apparatus of claim 6 wherein the second radius is substantially 90 degrees.

8. The smoking apparatus of claim 7 wherein the mouthpiece is adjacent to the second reservoir.

9. A smoking apparatus for the consumption of herbal medicines, tobacco, or other plant material in liquid or resin form comprising:

a thermal tip constructed from material capable of being heated by an outside heat source to a temperature emitting visible light;

an orifice disposed within the thermal tip;

a sealed air passageway connecting the orifice to a mouthpiece, wherein the sealed air passageway is connected to a first reservoir and a second reservoir wherein the first and second reservoirs are offset by a curve in the sealed air passageway; and wherein the thermal tip is tapered.

10. The smoking apparatus of claim 9 wherein the sealed air passageway, thermal tip, and first and second reservoirs are constructed from substantially clear, low-thermal-expansion, borosilicate glass.

11. The smoking apparatus of claim 9, wherein the first and second reservoirs are substantially spherical in shape.

12. The smoking apparatus of claim 11, wherein the substantially spherical first and second reservoirs have a nominal volume that is greater than the volume of the sealed air passageway over the distance between the first and second reservoirs.

13. The smoking apparatus of claim 9, wherein the sealed air passageway is substantially tubular and has an inside diameter that generally increases along a distance between the orifice and the mouthpiece.

14. The smoking apparatus of claim 9 wherein the curve is an s-shaped curve.

15. The smoking apparatus of claim 9 wherein the first and second reservoirs are offset by at least one centimeter.

16. The smoking apparatus of claim 9 wherein the mouthpiece is adjacent to the second reservoir.

17. An apparatus for vaporizing liquid or resin material for the purpose of inhaling vapor containing beneficial plant phytochemical compounds, the apparatus comprising a pipe constructed from substantially clear, low-thermal-expansion, borosilicate glass, wherein the pipe has a thermal tip with an orifice disposed within the thermal tip and an sealed air passageway connecting the orifice to a mouthpiece, wherein the air passageway is connected to a first reservoir and a second reservoir wherein the first and second reservoirs are offset by a curve in the air passageway, and wherein the thermal tip is tapered.

18. The smoking apparatus of claim 17, wherein the first and second reservoirs are substantially spherical in shape.

19. The smoking apparatus of claim 18, wherein the substantially spherical first and second reservoirs have a nominal volume that is greater than the volume of the sealed air passageway over a distance y between the first and second reservoirs.

20. The smoking apparatus of claim 17, wherein the sealed air passageway is substantially tubular and has an inside diameter that generally increases along a distance between the orifice and the mouthpiece.

* * * * *